United States Patent [19]

Smale

[11] 4,008,978

[45] Feb. 22, 1977

[54] CERAMIC TURBINE STRUCTURES

[75] Inventor: Charles H. Smale, Indianapolis, Ind.

[73] Assignee: General Motors Corporation, Detroit, Mich.

[22] Filed: Mar. 19, 1976

[21] Appl. No.: 668,428

[52] U.S. Cl. ..... 415/134; 415/135; 415/200; 415/214; 415/217

[51] Int. Cl.[2] ..... F01D 25/26

[58] Field of Search ..... 415/219 R, 218, 217, 415/134, 135, 137, 138, 139, 214, 200

[56] References Cited

UNITED STATES PATENTS

| | | | |
|---|---|---|---|
| 2,445,661 | 7/1948 | Constant et al. | 415/217 |
| 2,834,537 | 5/1958 | Neury | 415/217 |
| 3,048,452 | 8/1962 | Addie | 415/180 |
| 3,075,742 | 1/1963 | Aldag | 415/9 |
| 3,078,071 | 2/1963 | Henny et al. | 415/135 |
| 3,843,279 | 10/1974 | Crossley et al. | 415/138 |
| 3,857,649 | 12/1974 | Schaller et al. | 415/218 |

*Primary Examiner*—Henry F. Raduazo
*Attorney, Agent, or Firm*—J. C. Evans

[57] ABSTRACT

An outer ceramic shroud for a gas turbine engine includes a plurality of ceramic ring members each housing a rotating blade row of the turbine and further including ceramic stator vane stages located alternately between each of the ring members and having a radially outer rim portion thereon axially aligned with the ring members. The ring members and rims have tongue and groove means thereon for interconnection thereof into a continuous outer high temperature ceramic shroud maintained in axially assembled relationship by a pressure loaded piston member for applying a load to the shroud components during engine operation as a direct function of the discharge pressure of the engine compressor and a supplemental spring to load the shroud components when the discharge pressure drops, thereby to maintain the operative position of stator vane stages.

4 Claims, 3 Drawing Figures

CERAMIC TURBINE STRUCTURES

The invention herein described was made in the course of work under a contract or subcontract thereunder with the Department of Defense.

This invention relates to outer shrouds for gas turbine engines and more particularly to outer shroud constructions made of ceramic materials.

In order to operate gas turbine engines more efficiently, turbine inlet temperatures have continually been elevated into temperature ranges where it is desirable to form the outer shroud components of a gas turbine engine of a high temperature ceramic material that is suitable to contain elevated temperature combustion gases as they are directed from a high temperature combustor through the turbine stages of the engine.

In certain gas turbine engine applications, for example gas turbine engines having a gasifier turbine and a separate power turbine of a gas coupled type, it has been proposed to locate a single monolithic ceramic shroud member radially outwardly of the turbine stages for defining a flow path for the elevated temperature motive fluid as it is passed through the turbine stages. In such cases, it has been possible to form the shroud as a single monolithic member supported for axial movement in response to thermal expansion produced during engine operation. An example of such an arrangement is set forth in U.S. Pat. No. 3,078,071 issued Feb. 19, 1963, to Henny et al.

While such proposals are suitable for their intended purpose, there are other instances wherein a plurality of separate ring-like shroud members are interconnected axially of one another to form a gas flow passage for the motive fluid. An example of such a multi-axial stage turbine is set forth in U.S. Pat. No. 3,048,452, issued Aug. 7, 1962, to Addie. It includes internal spring elements for accommodating differential thermal expansion between outer casing components and the bearing support for the turbine rotor.

An object of the present invention is to provide a multi-stage axial turbine construction including a plurality of separate ceramic ring members and ceramic stator vane stage components joined by tongue and groove connections therebetween to form a single continuous outer ceramic shroud having opposite end portions thereon one of which is seated against a fixed abutment and the other of which is engaged by a movable piston member and a spring component for holding each of the separate shroud components together as a unit and to vary the force acting thereon to maintain connection between the tongue and groove joints therebetween in accordance with the operating conditions of the turbine thereby to accommodate for thermal expansion differennces between the shroud components and an engine housing support while maintaining a continuous secure gas tight interconnection therebetween during engine operation and to further assure accurate positioning of the stator vane stages.

Still another object of the present invention is to provide an easily assembled turbine shroud assembly of separate ceramic ring components joined together at tongue and groove joints to form a fluid-tight passage through turbine stages of a gas turbine ending and wherein combination spring and fluid pressure means are arranged to produce an axial force on the separate ring components to maintain them assembled and accurately positioned when the engine is inoperative and to apply a varying axial load thereon to accommodate thermal expansion differences between shroud support and shroud components produced by increases in temperature of the ring components throughout the engine operating cycle.

Still another object of the present invention is to provide an improved turbine engine assembly including a plurality of axially spaced, ceramic ring members located radially outwardly and circumferentially around axially spaced turbine stages and to interconnect each of the separate ceramic ring members by means of radially outer ring portions on ceramic stator vane stages between each of the turbine blade rows and wherein each of the ceramic ring members and ring portions have coacting tongue and groove means thereon for defining sealed joints therebetween; the sealed joints being maintained connected by a biasing assembly when the engine is inoperative and wherein pressure responsive means are operative in response to engine operation for accommodating axial expansion of the joined ceramic ring members and ceramic ring portions and their support components thereby to assure accurate positioning of the stator vane stages in the turbine gas flow path.

Further objects and advantages of the present invention will be apparent from the following description, reference being had to the accompanying drawings wherein a preferred embodiment of the present invention is clearly shown.

Figure 1:
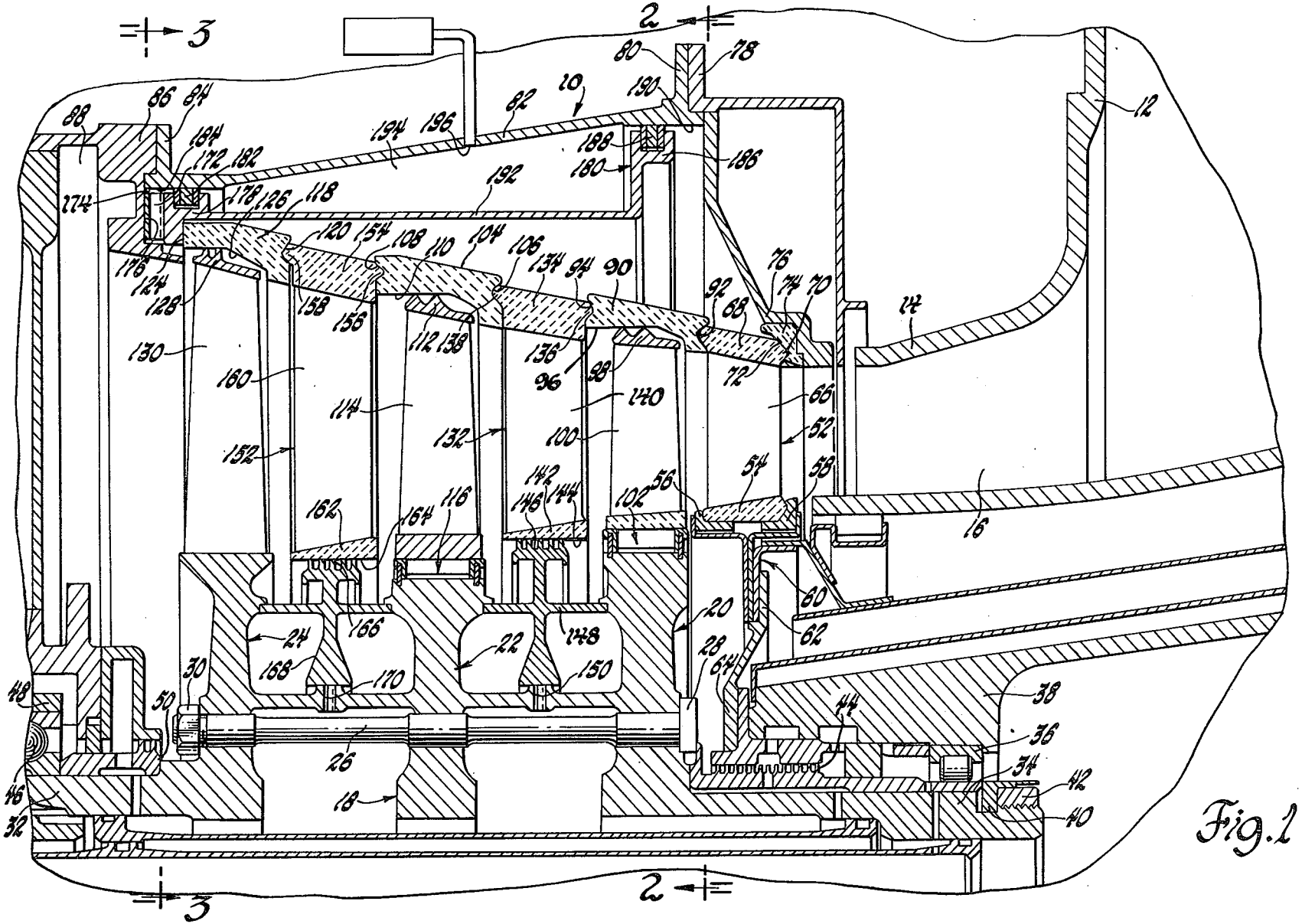
FIG. 1 is a vertical sectional view of a multi-stage axial turbine having the ceramic shroud construction of the present invention.
Figure 2:
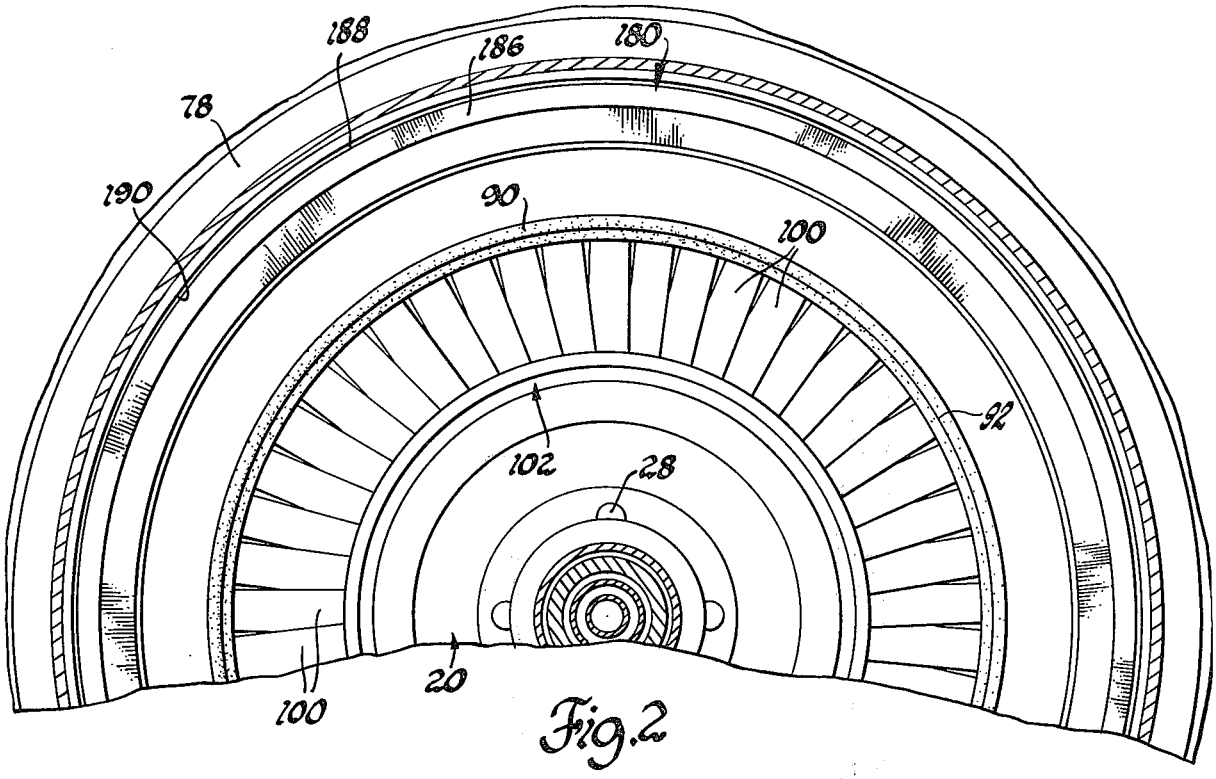
FIG. 2 is reduced, fragmentary, vertical sectional view taken along the line 2—2 of FIG. 1 looking in the direction of the arrows.

Referring now to FIG. 1, a turbine section 10 of a gas turbine engine is illustrated. It is shown in association with a portion of a combustor 12 of the type having fuel and compressed air directed thereto for combustion to produce combustion products at high temperature for discharge through a combustor outlet 14 that defines an annular flow path 16 for flow of the hot combustion gases from the combustor 12 into the turbine 10 of the gas turbine engine. The turbine includes a multi-stage rotor assembly 18 including an inlet rotor stage 20, an intermediate rotor stage 22 and an outlet rotor stage 24. In the illustrated arrangement, the assembly 18 is illustrated as including a plurality of tie rods 26 directed through aligned bores in the rotor stages 20, 22, 24. The tie rods 26 each includes a flanged head 28 on one end thereof overlapping the outboard surface of the rotor stage 20 and includes a threaded opposite end portion thereon that has a nut 30 threaded thereon for maintaining the tie rods 26 in place on the rotor assembly 18.

The rotor assembly 18 includes a shaft extension 32 thereon for connection to a load exteriorly of the engine. The opposite end of the rotor assembly 18 includes a shaft extension 34 that is rotatably supported by means of a bearing assembly 36 with respect to engine housing 38. Bearing 36 is held in place by means of an annular retainer 40 and a lock nut 42 threadably received on the outermost end of the extension 34. A labyrinth seal assembly 44 is located inboard of the bearing 36 for sealing between the outer periphery of the shaft extension 34 and the engine housing 38 against fluid leakage from the stages of the turbine 10 exteriorly thereof.

The opposite shaft extension 32 is also supported by a bearing 46 supported on a turbine housing 48. A labyrinth seal assembly 50 is located inboard of the bearing 46 to seal between the shaft extension 32 and the housing 48 at the opposite end of the turbine section 10.

An inlet turbine nozzle 52 of cast ceramic construction is located axially in line with the combustor outlet 14. It includes an annular radially inwardly located base 54 supported by means of axially spaced rings 56 and 58 on a sheet metal support assembly 60 supported by a grooved face 62 of an internal flange 64 secured to the labyrinth seal assembly 44 thence to the housing member 38. For purposes of the present invention-ceramic material references all are with respect to known high temperature material such as silicon nitride or equivalents.

The nozzle 52 of ceramic material further includes a plurality of nozzle vanes 66 spaced circumferentially around the annular base 54 to extend radially outwardly therefrom and having their radially outermost edges interconnected by an annular outer ring portion 68 having an outboard tongue 70 located in a V-shaped grooved inboard surface 72 of an abutment ring 74 of ceramic material. The annular base 54 and ring portion 68 are circumferentially segmented for ease of manufacture.

The abutment ring 74 is seated within a housing member 76 joined by an annular flange 78 to an abutting flange 80 of an outer casing 82. The outer casing 82 has a flanged opposite end 84 thereon connected to a casing member 86 defining an exhaust passageway 88 from the turbine section 10. Immediately downstream of the nozzle assembly 52 is a ceramic shroud ring member 90 having grooves 92, 94 on opposite ends thereof. The ring 90 has an inner surface 96 thereof located radially outwardly of, circumferentially around and in sealing engagement with a shroud ring 98 on the tips of a plurality of turbine blades 100 having their opposite end connected by means of a retainer assembly 102 on the outer periphery of the inlet rotor stage 20.

Likewise, the intermediate rotor stage 22 is circumferentially surrounded by a ceramic shroud ring member 104 of larger diameter than ring member 90 having oppositely grooved ends 106, 108 and an inner surface 110 loacated circumferentially around and outwardly of an in sealing engagement with a tip shroud 112 on a row of turbine blades 114 formed circumferentially around the rotor stage 22 and secured thereto by a connector assembly 116.

The last rotor stage 24 is circumferentially surrounded by a still larger diameter ceramic ring 118 having an upstream groove 120 thereon and a flat surface 124 on the opposite end thereof. It further includes an inner surface 126 located circumferentially around and radially outwardly of a blade tip shrough 128 formed circumferentially around a circumferentially spaced row of turbine blades 130 each secured to the rotor 24.

The turbine section 10 includes stator stages intermediate each of the rotor stages 20, 22, 24. A first stator stage 132 is located between the rotor stages 20, 22. It is a cast ceramic member having a radially outwardly directed ring portion 134 thereon having tongues 136, 138 on opposite ends thereof which are supportingly received within the groove 94 and groove 106 of rings 90, 104, respectively. The stator stage 132 includes a plurality of circumferentially spaced blades 140 connected to the outer ring portion 134 at their tips and to an annular base 142 at the radial root thereof. Ring portion 134 and annular base 142 are circumferentially segmented for ease of manufacture. The base 142 has an annular circumferential surface 144 thereof located in sealing engagement with a labyrinth seal 146 carried by a T-configured seal bracket 148 located between each of the rotor stages 20, 22 and having a base portion thereof secured by means of a screw element 150 to the rotor stages for rotation therewith. Likewise, the turbine section 10 includes a second downstream stator stage 152 formed as a cast ceramic member having a radially outwardly located ring portion 154 with tongues 156, 158 on opposite ends thereof, each respectively seated in the groove 108 of ring member 104 and the groove 120 of ring member 118. A plurality of stator blades 160 are connected at their outer tip to the ring portion 154 and at their root to an annular base 162 of the stator stage 152. Ring portion 154 and annular base 162 are circumferentially segmented for ease of manufacture. Base 162 includes a circumferential, radially inner surface 164 located in sealing engagement with a labyrinth seal 166 supported by a T-configured seal support bracket 168 located between rotor stages 22, 24 and secured thereto by means of a screw element 170.

The provision of separate ceramic shroud ring members 90, 104 and 118 around each of the rotor stages and the interposed ceramic stator ring portions 134, 154 define a convergent, annular gas flow passageway from the combustor outlet 14 to the exhaust passage 88. The component parts of the convergent assembly for defining the hot gas flow passage are separate from one another to permit ease of assembly. In accordance with the present invention the separate parts are joined by a tongue and groove joint configuration to axially align the component parts from the inlet end to the outlet end of the turbine section 10.

Figure 3:
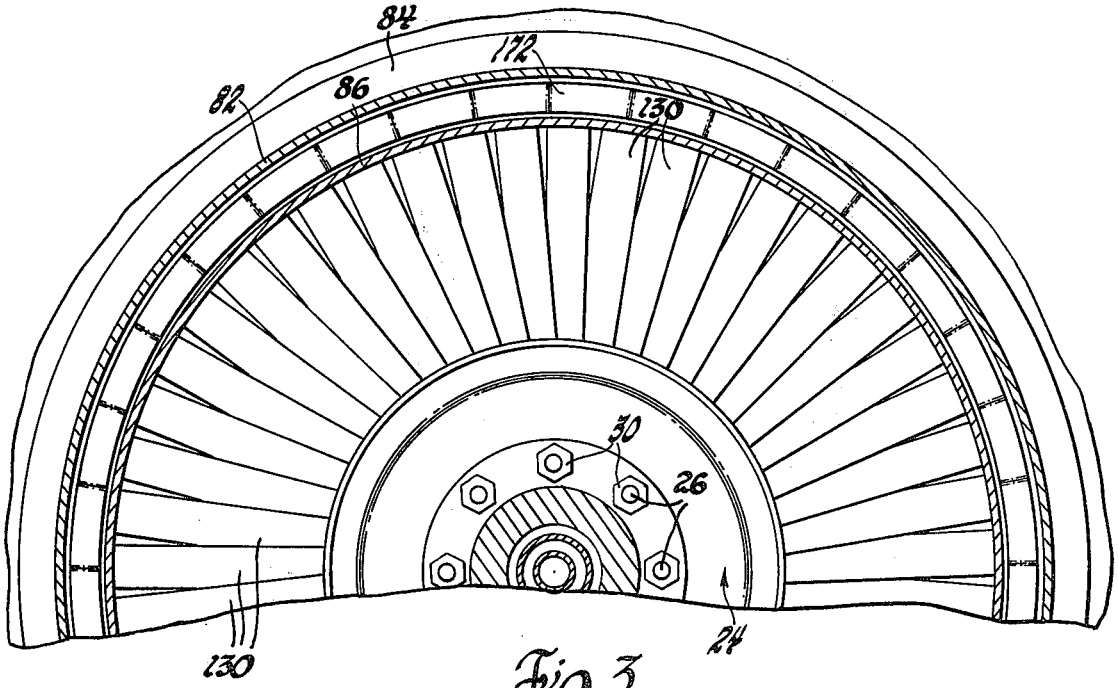
FIG. 3 is a reduced, fragmentary, vertical sectional view taken along the line 3—3 of FIG. 1 looking in the direction of the arrows.

To maintain the separate component parts of the shroud assembly together when engine operation produces no discharge pressure, the turbine section 10 includes a large diameter, spring element 172 supported within a cavity 174 inboard of the flange 84 on the outer casing 82. The spring element 172, as best seen in FIG. 3, is a wave spring component that is compressed between the end surface 176 and a small diameter end 178 of a piston assembly 180.

A radially outwardly located annular seal 182 is supported in an outer grooved surface of the small diameter end 178. The seal 182 is slidably received in a bore 184 formed on one end of the outer housing 82. The opposite end of the piston 180 includes a large diameter end 186 thereon having a seal 188 supported in a grooved outer surface thereof to be slidably supported within a bore 190 on the outer casing 82 at the opposite end thereof from the bore 184. The piston assembly 180 includes an annular tubular portion 192 between the end portions 178 and 186 which is located radially inwardly of the outer casing 82 to define a pressurizable chamber 194 in communication with a source of pressure through a port 196. For example, the pressure can be that at the discharge of a compressor for supplying air to the combustor 12.

During periods when the turbine 10 is not running, the spring 172 will maintain a force through the small diameter end 178 of the piston against the end face 124 of the ring member 118 so as to maintain the tongue/-groove joints joined between each of the axial multi-stage shroud components. This maintains the stator vane stages 132, 152 properly positioned in the engine for subsequent hot gas flow thereacross.

During turbine operation, when hot discharge gases are directed to the combustor outlet 14, thence through the inlet nozzle 52 to the multi-stage turbine rotor stages 20, 22, 24 the metal housing member 76 will expand more than the ring components of the shroud assembly. In accordance with the present invention, the pressure in the chamber 194 will increase and act on the piston assembly 180 across the large diameter end 186 thereof to move end 186 against the ring 118. The ceramic rim components are forced axially against the abutment ring 74 thereby to maintain the rings 90, 104, 118 tightly against adjacent stator vane stages 132, 152 and nozzle 52. Thus, differences in thermal expansion are compensated during engine operation. The stator vane stages 132, 152 and nozzle 52 will be tightly maintained in a desired position against gas forces imposed on their vane components during engine operation.

The compressor discharge pressure will vary in accordance with the engine load and with the temperature of the combustion products from the combustor 12 and will produce a pressure force to accommodate for variable thermal expansion in the ceramic ring components and their support so as to maintain an optimum load between the tongue and groove joint portions of the turbine shroud assembly thereby to accomplish the aforesaid maintenance of stator vane position and to maintain an adequate bias between the separate shroud components so as to maintain a desired sealed relationship between each of the stator and rotor stages to prevent bypass of combustion products from the continuous outwardly convergent flow passageway between the inlet 16 and the exhaust passageway 88.

While the embodiments of the present invention as herein disclosed, constitute a preferred form, it is to be understood that other forms might be adopted.

The embodiments of the invention in which an exclusive property or privilege is claimed are defined as follows:

1. A gas turbine comprising a turbine wheel having a turbine blade row therein, a ceramic ring member spaced radially outwardly of said blade row to define a flow passage therethrough, a ceramic stator vane stage interposed axially of said turbine blade row, said stator vane stage including a radially outwardly located ring portion, coacting tongue and groove means on said ring member and said ring portion to join said ring member and ring portion at an axial joint therebetween to define a continuous outer wall having opposite ends thereon, support means including an annular ceramic stop ring in engagement with one of said opposite ends, an axially movable piston in engagement with the other of said opposite ends, and means for applying a primary force on said piston to maintain the joint between said ring member and ring portion as the turbine temperature increases thereby to hold said stator vane stage in a desired position with respect to said support means notwithstanding differences in thermal expansion between said stator vane stage and said support means.

2. A gas turbine comprising a turbine wheel having a turbine blade row therein, a ceramic ring member spaced radially outwardly of said blade row to define a flow passage therethrough, a ceramic stator vane stage interposed axially of said turbine blade row, said stator vane stage including a radially outwardly located ring portion, coacting tongue and groove means on said ring member and said ring portion to join said ring member and ring portion at an axial joint therebetween to define a continuous outer wall having opposite ends thereon, support means including an annular ceramic stop ring in engagement with one of said opposite ends, an axially movable double-ended piston having one end thereof in engagement with the other of said opposite ends, and means for directing compressor discharge pressure on said piston at the opposite end thereof to apply a primary force from said piston to said other of said opposite ends to maintain the joint between said ring member and ring portion as the turbine temperature increases thereby to hold said stator vane stage in a desired position with respect to said support means notwithstanding differences in thermal expansion between said stator vane stage and said support means.

3. A gas turbine comprising a turbine wheel having a turbine blade row therein, a ceramic ring member spaced radially outwardly of said blade row to define a flow passage therethrough, a ceramic stator vane stage interposed axially of said turbine blade row, said stator vane stage including a radially outwardly located ring portion, coacting tongue and groove means on said ring member and said ring portion to join said ring member and ring portion at an axial joint therebetween to define a continuous outer wall having opposite ends thereon, support means including an annular ceramic stop ring in engagement with one of said opposite ends, an axially movable piston in engagement with the other of said opposite ends, supplemental spring means acting on said other of said opposite ends to produce a selected load for holding said tongue and groove means together under first turbine conditions, and means for applying a primary force on said piston to maintain the joint between said ring member and ring portion as the turbine temperature increases thereby to hold said stator vane stage in a desired position with respect to said support means notwithstanding differences in thermal expansion between said stator vane stage and said support means.

4. A gas turbine comprising a turbine wheel having a plurality of axially spaced turbine blade rows thereon, a plurality of ceramic ring members spaced axially of each other and radially outwardly of each of said blade rows to define a flow passage therethrough, a ceramic stator vane stage interposed axially between each of said turbine blade rows, each of said stator vane stages including a radially outwardly located ring portion, coacting tongue and groove means on each of said ring portions and said ring members to join said rings axially of one another to define a continuous outer wall around said alternately arranged blade rows and stator vane stages having opposite ends thereon, an annular ceramic stop ring in engagement with one of said opposite ends, an axially movable piston in engagement with the other of said opposite ends, spring means acting on said other of said opposite ends to bias it toward said stop ring to produce a selected load for holding said tongue and groove means together under cold conditions, and means for applying a pressure force on said piston to hold said ring portions and ring members together as the turbine temperature increases so as to maintain the position of said stator vane stages.

* * * * *